US007941931B2

(12) United States Patent
Prudden, Jr.

(10) Patent No.: US 7,941,931 B2
(45) Date of Patent: May 17, 2011

(54) WET SHAVING RAZOR AND PROTECTIVE COVER ASSEMBLY

(76) Inventor: John Prudden, Jr., Essex, MA (US)

( * ) Notice: Subject to any disclaimer, the term of this patent is extended or adjusted under 35 U.S.C. 154(b) by 0 days.

(21) Appl. No.: 12/777,356

(22) Filed: May 11, 2010

(65) Prior Publication Data

US 2010/0218390 A1 Sep. 2, 2010

Related U.S. Application Data

(62) Division of application No. 12/006,959, filed on Jan. 8, 2008, now abandoned.

(51) Int. Cl.
*B26B 21/40* (2006.01)

(52) U.S. Cl. ..... 30/539

(58) Field of Classification Search ..... D28/46, D28/47; 30/539–541; 206/352–360
See application file for complete search history.

(56) References Cited

U.S. PATENT DOCUMENTS 1,958,600 A 5/1934 Wright
1,974,175 A * 9/1934 Coggins ..... 30/539
1,979,123 A * 10/1934 Taylor, Jr. ..... 30/539
D149,614 S * 5/1948 Carr ..... 30/541
3,277,571 A * 10/1966 Bloomfield ..... 30/540
3,287,803 A * 11/1966 Wauters ..... 30/539
3,290,778 A 12/1966 Hickerson
3,327,388 A 6/1967 Sooter
3,339,608 A * 9/1967 Brenner ..... 30/540
3,346,952 A * 10/1967 Harris ..... 30/541
D210,713 S * 4/1968 Hamill ..... D28/47
3,378,922 A * 4/1968 Schrader et al. ..... 30/539
3,396,465 A 8/1968 Kinght et al.
3,396,466 A * 8/1968 Suzuki ..... 30/541
3,399,455 A 9/1968 Steere, Jr.
3,408,737 A 11/1968 Steere, Jr. et al.
3,419,959 A 1/1969 Lively, Jr.
3,444,990 A * 5/1969 Braginetz ..... 206/352
3,576,071 A 4/1971 Eriksen
(Continued)

FOREIGN PATENT DOCUMENTS

EP 0 878 275 A1 11/1998

OTHER PUBLICATIONS

PCT International Search Report with Written Opinion in corresponding Int'l appln. PCT/IB2009/050022 dated May 12, 2009.

*Primary Examiner* — Jason Daniel Prone
(74) *Attorney, Agent, or Firm* — John M. Lipchitz; Kevin C. Johnson; Steven W. Miller

(57) ABSTRACT

A protective cover for a razor cartridge. The cartridge is joined to a handle and is pivotal about a pivot axis with respect to the handle. The cover includes a front wall, a back wall opposed to the front wall, a side wall extending from the front wall to the back wall, a first end and an opposed second end. The second end has an opening. The back wall has an opening with first and second pivot inhibiting members extending away from the back wall and towards the front wall. The cover is slidable over the cartridge through the opening in the second end to cover the cartridge such that the first and second pivot inhibiting members engage the handle to inhibit the cartridge from pivoting about the pivot axis with respect to the handle.

8 Claims, 4 Drawing Sheets

U.S. PATENT DOCUMENTS

| | | | | | |
|---|---|---|---|---|---|
| 3,609,862 | A | * | 10/1971 | Ernstberger | 30/539 |
| D226,642 | S | * | 4/1973 | Ferrier, Jr. | 30/539 |
| 3,760,938 | A | * | 9/1973 | Ferrier, Jr. | 30/539 |
| 3,771,223 | A | | 11/1973 | Dawidowicz et al. | |
| 3,915,300 | A | * | 10/1975 | Gatley | 30/539 |
| 3,941,244 | A | | 3/1976 | Braginetz | |
| 4,328,615 | A | | 5/1982 | Bowman et al. | |
| D274,010 | S | | 5/1984 | Iten | |
| 4,476,630 | A | | 10/1984 | Byrne | |
| 4,587,730 | A | | 5/1986 | Iten | |
| D284,316 | S | | 6/1986 | Halm | |
| 4,601,392 | A | | 7/1986 | Althaus | |
| RE32,367 | E | | 3/1987 | Bowman et al. | |
| 4,742,909 | A | | 5/1988 | Apprille et al. | |
| 4,777,722 | A | | 10/1988 | Trotta | |
| D312,181 | S | | 11/1990 | Terner | |
| D312,568 | S | | 12/1990 | Gray | |
| 5,042,658 | A | * | 8/1991 | Tiramani et al. | 30/541 |
| 5,095,621 | A | | 3/1992 | Rapp | |
| D334,082 | S | * | 3/1993 | Tiramani et al. | D28/47 |
| 5,771,592 | A | | 6/1998 | Nizker | |
| 5,893,213 | A | | 4/1999 | Motta | |
| 6,185,827 | B1 | | 2/2001 | Polites | |
| D449,710 | S | | 10/2001 | Wonderley | |
| 6,539,633 | B1 | * | 4/2003 | Rebaudieres | 30/539 |
| 7,093,363 | B1 | * | 8/2006 | Kuo | 30/541 |
| D616,148 | S | * | 5/2010 | Wonderley | D28/47 |
| D619,300 | S | * | 7/2010 | Wonderley | D28/47 |
| 7,753,197 | B2 | * | 7/2010 | Russell | 206/352 |
| D624,242 | S | * | 9/2010 | Bridges et al. | D28/47 |
| 2007/0289139 | A1 | | 12/2007 | Peyser et al. | |
| 2009/0056151 | A1 | * | 3/2009 | Kohring et al. | 30/541 |
| 2009/0172957 | A1 | * | 7/2009 | Prudden, Jr. | 30/539 |
| 2009/0172958 | A1 | * | 7/2009 | Prudden et al. | 30/539 |
| 2009/0321292 | A1 | * | 12/2009 | Prudden et al. | 206/354 |
| 2011/0005089 | A1 | * | 1/2011 | Sennett et al. | 30/539 |

* cited by examiner

WET SHAVING RAZOR AND PROTECTIVE COVER ASSEMBLY

This application is a divisional of application Ser. No. 12/006,959, filed on Jan. 8, 2008 now abandoned.

FIELD OF THE INVENTION

This invention relates to a wet shaving razor cover that protects the shaving cartridge and more particularly protects the pivot mechanism from damage during transport and/or storage.

BACKGROUND OF THE INVENTION

Over the years, consumers have become more mobile in their daily lives. This becomes even more apparent as the goods that are commonly used by consumers are tailored for improved mobility and easy travel by manufacturers that recognize this behavior change. One consumer area that has followed this trend is wet shaving razors in that a number of razors are intended for a relatively limited number of uses (referred to as "disposable") while others are in the form of systems that comprise a longer term use handle that is joined to a removably disposable cartridge. With respect to both types of razor products, it is becoming more commonplace for such razors to incorporate a pivot mechanism allowing the cartridge to pivot with respect to the handle. As manufacturers strive to present consumers with a pivoting mechanism, which provides an improved shave, it is clear that there is a need for a protective razor cover that is suitable for such razors during transport and/or storage. In particular, there is a need for a protective razor cover that is suitable for 1) storing the razor in a manner that protects a consumer from unintended contact with the cutting edges of the blades during transport and/or storage, 2) protecting the cutting edges of the blades from dulling by unintended contact during such transport and/or storage, and 3) protecting the pivoting mechanism from damage during transport and/or storage.

SUMMARY OF THE INVENTION

In accordance with the present invention a protective cover for a razor cartridge is provided. The razor cartridge is joined to a handle and is pivotal about a pivot axis with respect to the handle. The cover comprises a front wall, a back wall opposed to the front wall, a side wall extending from the front wall to the back wall, a first end and an opposed second end. The second end has an opening. The back wall has an opening, a first pivot inhibiting member extending away from the back wall and a second pivot inhibiting member extending away from the back wall. Preferably, the first and second pivot inhibiting members are positioned opposite one another on either side of the opening in the back wall. The cover is slidable over the cartridge through the opening in the second end to cover the cartridge such that the handle extends through the opening in the back wall and the first and second pivot inhibiting members engage the handle to inhibit the cartridge from pivoting about the pivot axis with respect to the handle.

The first and second pivot inhibiting members may extend towards the front wall. The first and second pivot inhibiting members may extend away from the front wall.

The front wall may comprise a plurality of guides to minimize movement of the cover with respect to the cartridge. The back wall may comprise a plurality of guides to minimize movement of the cover with respect to the cartridge.

The first pivot inhibiting member may be positioned adjacent the opening in the back wall. The second pivot inhibiting member may be adjacent the opening in the back wall.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
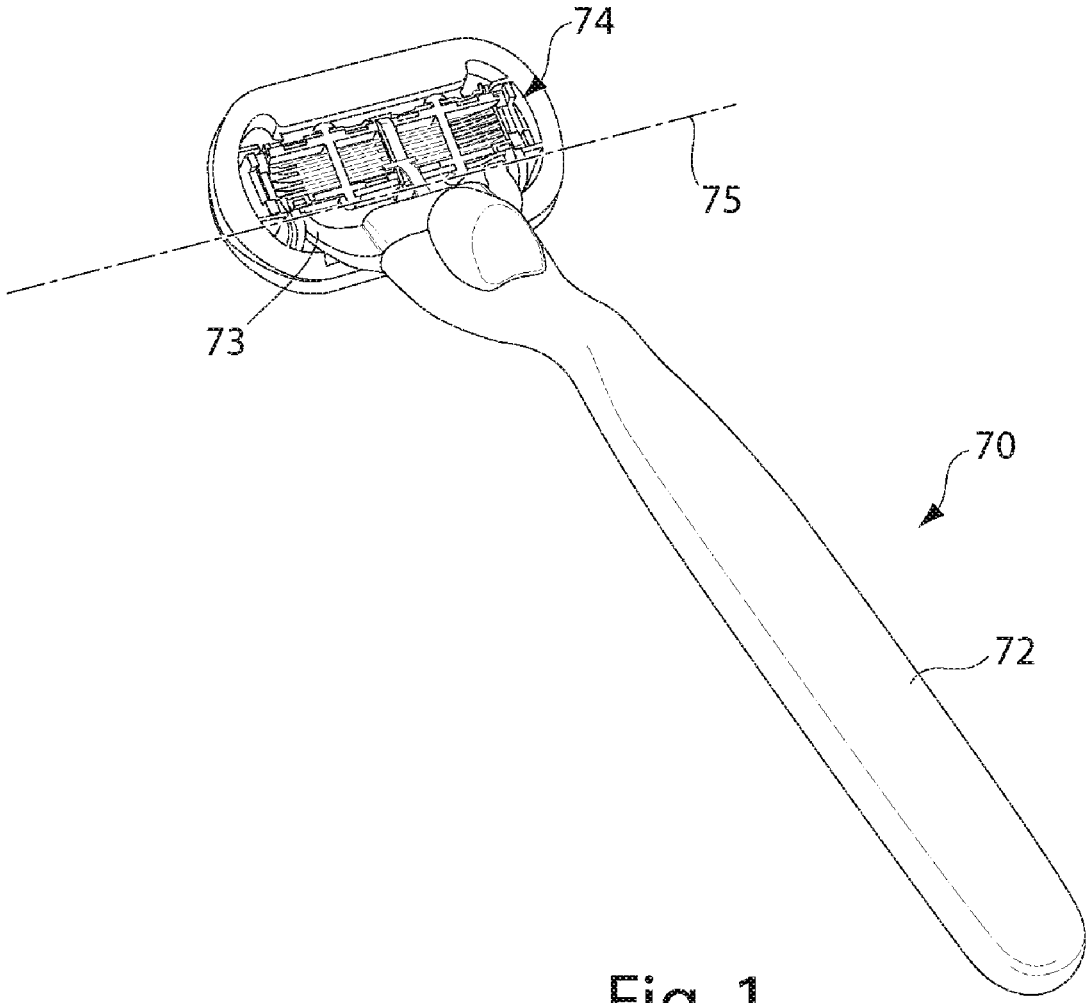
FIG. 1 is a perspective view of a razor which may be stored in the protective cover of the present invention.

Referring to FIG. 1 there is shown a wet shaving razor 70. Wet shaving razor 70 comprises a handle 72 and a cartridge 74 joined to handle 72. The razor 70 may be disposable where the handle 72 and cartridge are disposed of after use. Alternatively, the razor 70 may be in the form of a system that comprises a longer term use handle 72 that is reused and a removable disposable cartridge 74 that is disposed after use and replaced with a new cartridge. The cartridge 74 is pivotal about a pivot axis 75 with respect to handle 72. The pivot mechanism 73 enables the cartridge 74 to pivot about pivot axis 75 with respect to handle 72.

Figure 2:
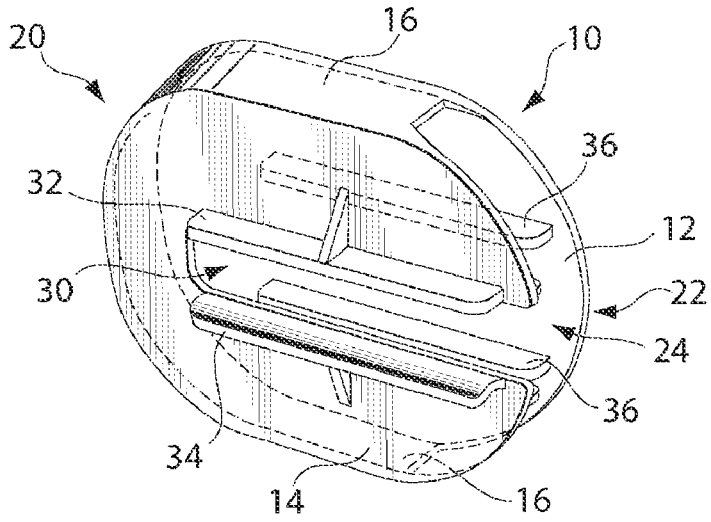
FIG. 2 is a perspective view of a protective cover of the present invention.
Figure 3:
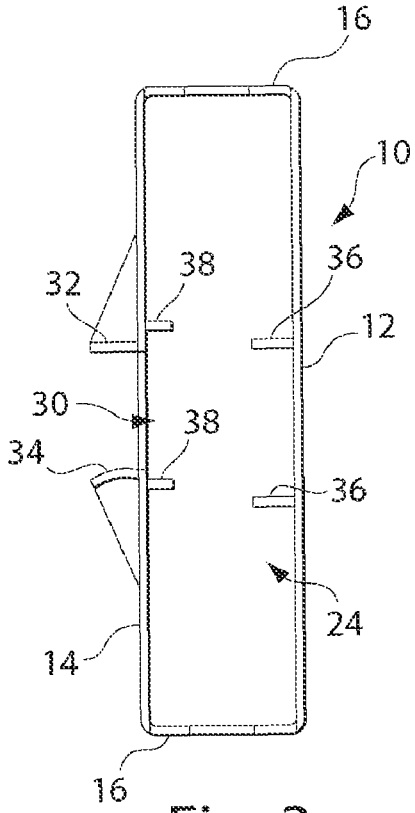
FIG. 3 is an end view of the protective cover of FIG. 2.
Figure 4:
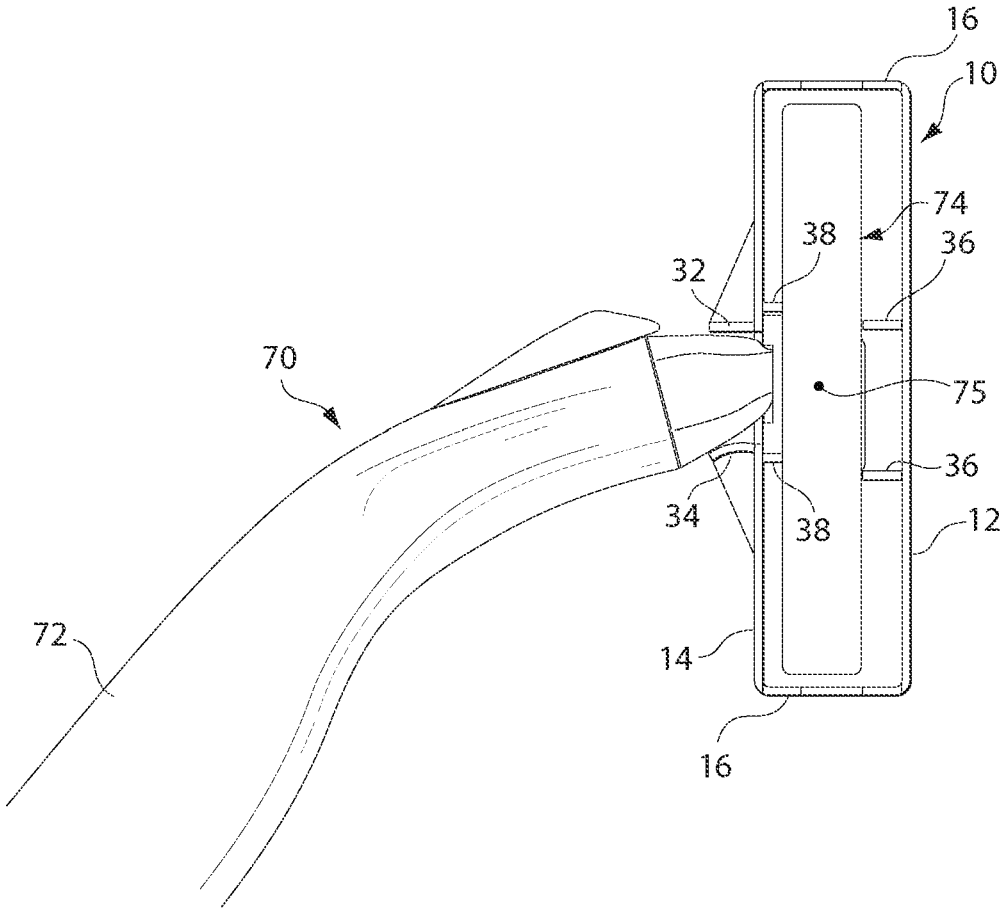
FIG. 4 is an end view of the protective cover of FIG. 2 covering the razor of FIG. 1.

Referring to FIGS. 2-4, there is shown a protective cover 10 suitable for storage of a razor 70 having a cartridge 74 and an adjoining handle 72. The cover 10 comprises a front wall 12, a back wall 14 opposed to the front wall 12 and a side wall 16 extending from the front wall 12 to the back wall 14. The side wall 16 extends between the front wall 12 and the back 14 connecting the front wall 12 with the back wall 14. The side wall 16 extends around a portion of protective cover 10. The side wall 16 may extend continuously or may be intermittent. The cover 10 also comprises a first end 20 and an opposed second end 22. The second end 22 has an opening 24. The back wall 14 has an opening 30, a first pivot inhibiting member 32 extending away from the back wall 14 and a second pivot inhibiting member 34 extending away from the back wall 14. The cover 10 is slidable over the cartridge 74 through the opening 24 in the second end 22 to cover the cartridge 74. When the cover 10 covers cartridge 74 handle 72 extends through the opening 30 in the back wall 14 and the first and second pivot inhibiting members, 32 and 34, engage the handle 72 to inhibit the cartridge 74 from pivoting about the pivot axis 75 with respect to the handle 72. This protects the pivot mechanism from damage during transport and/or storage.

In the embodiment shown in FIGS. 2-4 the first pivot inhibiting member 32 and the second pivot inhibiting member 34 extend away from the front wall 12. The first pivot inhibiting member 32 is positioned adjacent opening 30 in back wall 14. Similarly, the second pivot inhibiting member 34 is positioned adjacent opening 30 in back wall 14 opposite to the first pivot inhibiting member 32.

The front wall 12 comprises a plurality of guides 36 to minimize movement of the cover 10 with respect to the cartridge 74. The back wall 14 comprises a plurality of guides 38 to minimize movement of said cover with respect to said cartridge.

Figure 5:
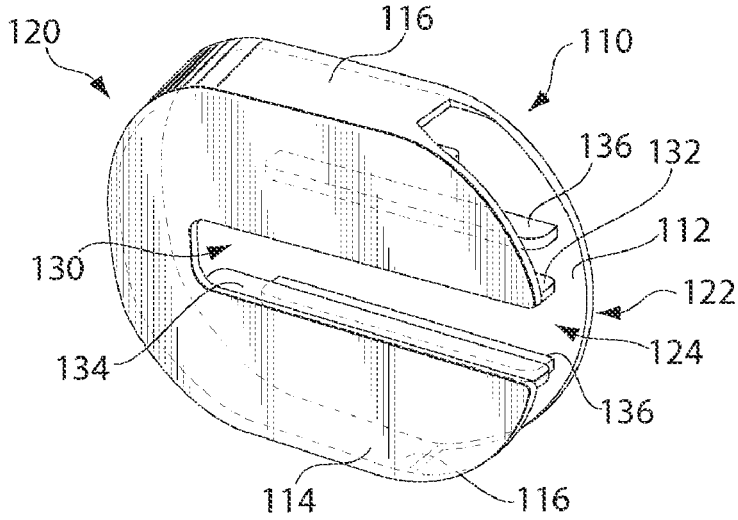
FIG. 5 is a perspective view of another protective cover of the present invention.
Figure 6:
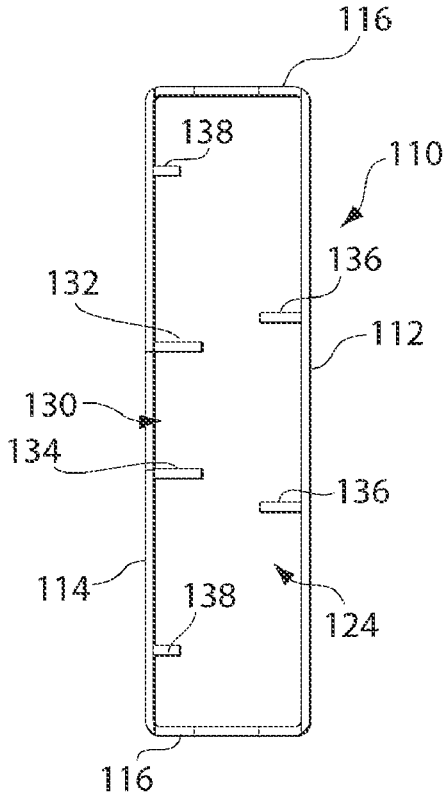
FIG. 6 is an end view of the protective cover of FIG. 5.

Referring to FIGS. 5-6, there is shown another protective cover 110 suitable for storage of a razor 70 shown in FIG. 1. The cover 110 comprises a front wall 112, a back wall 114 opposed to the front wall 112 and a side wall 116 extending from the front wall 112 to the back wall 114. The side wall 116 extends between the front wall 112 and the back 114 connecting the front wall 112 with the back wall 114. The side wall 116 extends around a portion of protective cover 110. The side wall 116 may extend continuously or may be intermittent. The cover 110 also comprises a first end 120 and an opposed second end 122. The second end 122 has an opening 124. The back wall 114 has an opening 130, a first pivot inhibiting member 132 extending away from the back wall 114 and a second pivot inhibiting member 134 extending away from the back wall 114. The cover 110 is slidable over the cartridge 74 through the opening 124 in the second end 122 to cover the cartridge 74. When the cover 110 covers cartridge 74 handle 72 extends through the opening 130 in the back wall 114 and the first and second pivot inhibiting members, 132 and 134, engage the handle 72 to inhibit the cartridge 74 from pivoting about the pivot axis 75 with respect to the handle 72. This protects the pivot mechanism from damage during transport and/or storage.

The first pivot inhibiting member 132 and the second pivot inhibiting member 134 extend toward the front wall 112. The first pivot inhibiting member 132 is positioned adjacent opening 130 in back wall 114. Similarly, the second pivot inhibiting member 134 is positioned adjacent opening 130 in back wall 114 opposite to the first pivot inhibiting member 132.

The front wall 112 comprises a plurality of guides 136 to minimize movement of the cover 110 with respect to the cartridge 74. The back wall 114 comprises a plurality of guides 138 to minimize movement of said cover with respect to said cartridge.

The cover of the present invention is preferably molded as a single integral structure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet shaving razor and a protective cover assembly comprising:

a cartridge, a cover, and a handle, said cartridge being joined to the handle and being pivotal about a pivot axis with respect to said handle, said cover comprising:

a front wall, a back wall opposed to said front wall, a side wall extending from said front wall to said back wall, a first end and an opposed second end, said second end having an opening, said back wall having an opening, a first pivot inhibiting member extending away from said back wall and a second pivot inhibiting member extending away from said back wall, said cover being slidable over said cartridge through said opening in said second end to cover said cartridge such that said handle extends through said opening in said back wall and said first and second pivot inhibiting members engage said handle to inhibit said cartridge from pivoting about said pivot axis with respect to said handle, and wherein said first and second pivot inhibiting members extend towards said front wall.

2. The cover of claim 1 wherein the side wall extends continuously around a portion of the cover.

3. The cover of claim 1 wherein said first and second pivot inhibiting members extend away from said front wall.

4. The cover of claim 1 wherein said front wall further comprises a plurality of guides to minimize movement of said cover with respect to said cartridge.

5. The cover of claim 1 wherein said back wall further comprises a plurality of guides to minimize movement of said cover with respect to said cartridge.

6. The cover of claim 1 wherein said first pivot inhibiting member is adjacent said opening in said back wall.

7. The cover of claim 1 wherein said second pivot inhibiting member is adjacent said opening in said back wall.

8. The cover of claim 1 wherein said first and second pivot inhibiting members extend toward said front wall.

* * * * *